United States Patent [19]

Levy

[11] 4,337,945

[45] Jul. 6, 1982

[54] ROULETTE GAMING APPARATUS

[76] Inventor: David Levy, 360 W. 55th St., New York, N.Y. 10019

[21] Appl. No.: 132,085

[22] Filed: Mar. 20, 1980

[51] Int. Cl.[3] ..... A63F 5/04

[52] U.S. Cl. ..... 273/142 E; 273/129 S

[58] Field of Search ..... 273/142 R, 142 A, 142 B, 273/142 C, 142 D, 142 E, 142 F, 142 G, 142 J, 129 S, 129 R, 357, 109, 119 R, 119 A, 120 R, 129 T, 129 Q; 124/29

[56] References Cited

U.S. PATENT DOCUMENTS

| | | | |
|---|---|---|---|
| 497,906 | 5/1893 | Bettini | 273/142 R |
| 1,343,127 | 6/1920 | Hallinan | 273/129 S UX |
| 1,385,677 | 7/1921 | Gillette | 273/129 S X |
| 1,527,876 | 2/1925 | Janik | 273/119 R X |
| 2,044,177 | 6/1936 | McLoughlin | 273/142 E X |
| 2,104,740 | 1/1938 | Evans | 273/142 E |
| 3,464,700 | 9/1969 | Clatterbuck | 273/119 R |

FOREIGN PATENT DOCUMENTS

| | | | |
|---|---|---|---|
| 494398 | 3/1930 | Fed. Rep. of Germany | 273/142 B |
| 660727 | 6/1938 | Fed. Rep. of Germany | 273/129 S |
| 2303575 | 10/1976 | France | 273/142 B |

*Primary Examiner*—Richard J. Apley
*Assistant Examiner*—Arnold W. Kramer
*Attorney, Agent, or Firm*—Karl F. Ross

[57] ABSTRACT

A gaming apparatus in which a roulette wheel has a circular rim and a downwardly converging frustoconical bowl contained within the rim and joined thereto forming a track therewith for a roulette ball and a rotatable wheel head centered within the bowl at the bottom thereof and formed with a plurality of numbered compartments for receiving the roulette ball. An automatic roulette ball spinner having at least one guide tube is positioned along the rim for directing the roulette ball onto the track and is provided with a powered plunger for propelling the roulette ball through the guide tube. The guide tube is vertically moveable for lowering it onto the track to discharge the ball and then raising it to allow the ball to travel around the track uninterruptedly.

7 Claims, 6 Drawing Figures

ROULETTE GAMING APPARATUS

FIELD OF THE INVENTION

The present invention relates, in general, to a gaming apparatus requiring the use of a ball, and, more particularly, to a roulette wheel having an automatic ball spinner.

BACKGROUND OF THE INVENTION

In the game of roulette, the dealer, by hand, spins the rotatable central portion of the roulette wheel, known as the wheel head, in one direction while spinning the roulette ball, again by hand, in the opposite direction on the track formed around the periphery of the downwardly sloping bowl. As the speed of the ball diminishes, it rolls down the sloping bowl and enters one of a series of numbered compartments formed along the periphery of the wheel head, the compartments being alternately colored black and red.

The object of the game is for the players to guess the number of which compartment the ball will enter, or which color it will land on, or even chosing a group of numbered compartments, any of which if entered by the ball is considered a correct guess.

One of the problems encountered in the game of roulette is the fact that the dealer can, to a certain extent, control which compartment or at least which group of compartments or color the ball will enter, by adjusting the speed and the moment of release of the ball relative to the spinning wheel head, so that the possibility of collusion between the dealer and a player can exist.

OBJECTS OF THE INVENTION

It is therefore an object of the present invention to provide an improved roulette wheel adapted to obviate the aforementioned drawback.

SUMMARY OF THE INVENTION

The above and other objects of the invention are realized by the combination of a standard roulette wheel having a circular rim surrounding the downwardly converging frustoconical bowl and forming therewith the track around which the roulette ball travels and an automatic ball spinner having a pair of oppositely directed guide tubes positioned along the rim for propelling the ball onto the track.

The pair of guide tubes intersect one another and are mounted in a common yoke which is vertically displaceable along vertical guides by a jack powered either electrically or pneumatically. The rear ends of the guide tubes are fitted with plungers also powered either electrically or pneumatically, which when activated, strike the ball to propell it out of the guide tube and onto the track. At the intersection of the guide tubes there is provided a magazine in the form of a vertical tube communicating with the interior of the guide tubes at the point of intersection for feeding balls to be propelled through the guide tubes.

A ball can be propelled from either guide tube depending upon which plunger is activated, the activation being randomly controlled, as well as the striking force of the plunger, which is also randomly controlled and will affect the speed of the ball.

Normally, the guide tubes rest on the track until the dealer activates the system, which randomly selects a plunger and the propelling force and the ball is displaced onto the track, at which point the jack is automatically activated and the guide tubes are vertically displaced from the track to allow the ball to travel around the track uninterrupted. As soon as the ball leaves the chosen guide tube, the dealer spins the wheel head in the opposite direction to the ball travel. When the ball finally comes to rest in a compartment, the dealer deactivates the system and the guide tubes settle down and come to rest on the track.

In another embodiment of the invention, the two guide tubes are separate and are formed in the rim oppositely directed and communicating with the track by way of a bore in axial alignment with each tube and blocked by an arcuate flap biased into a closed position and displaceable into an open position by the ball as it is propelled through the bore. In this embodiment, once again, the plungers can be operated either electrically or pneumatically and in the same random manner as already described.

BRIEF DESCRIPTION OF THE DRAWING

The above and other objects, features and advantages of the invention will become more readily apparent from the following description reference being made to the accompanying drawing, in which.

SPECIFIC DESCRIPTION

Figure 1:
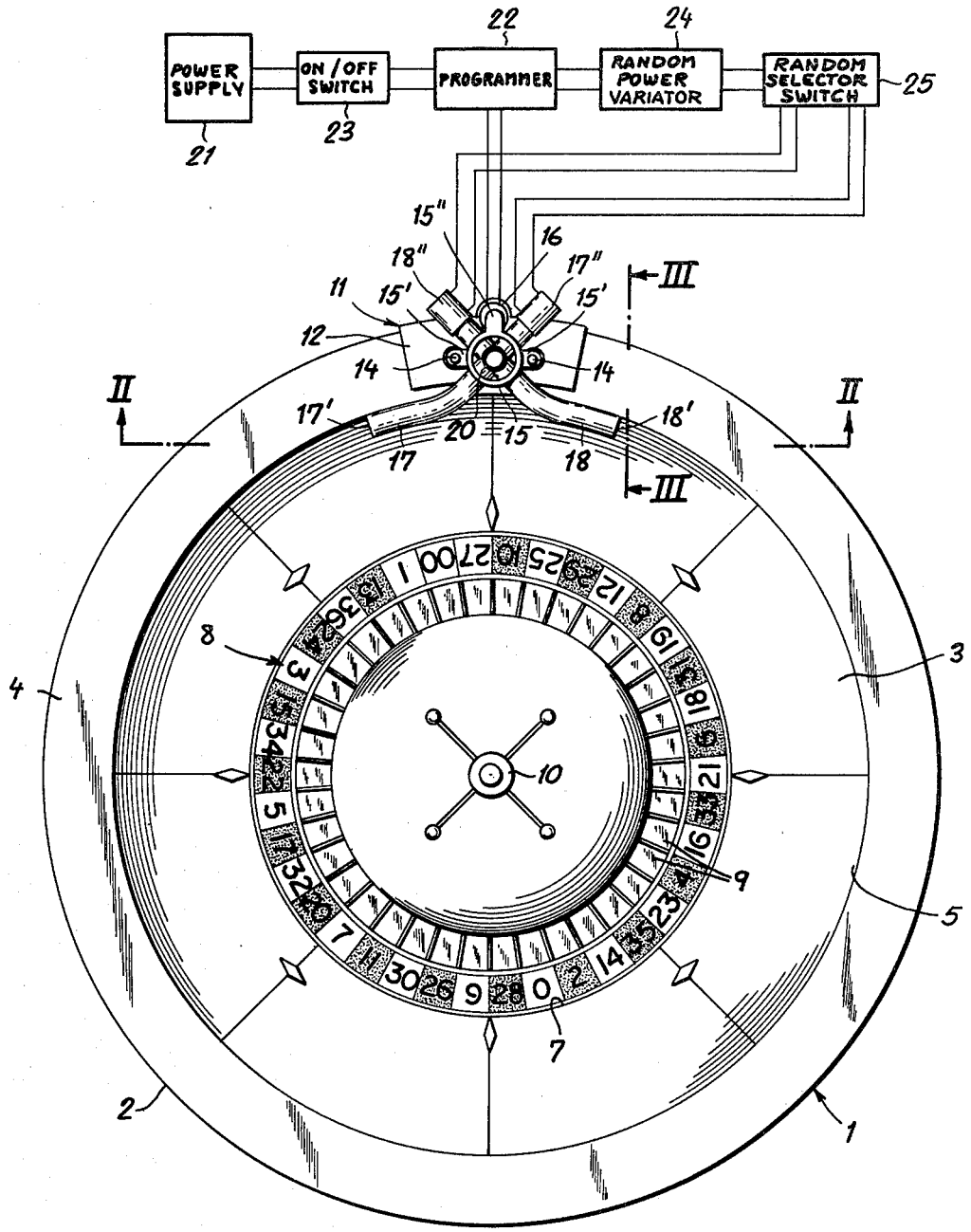
FIG. 1 is a top view of a roulette wheel having an automatic ball spinner according to the invention.
Figure 2:
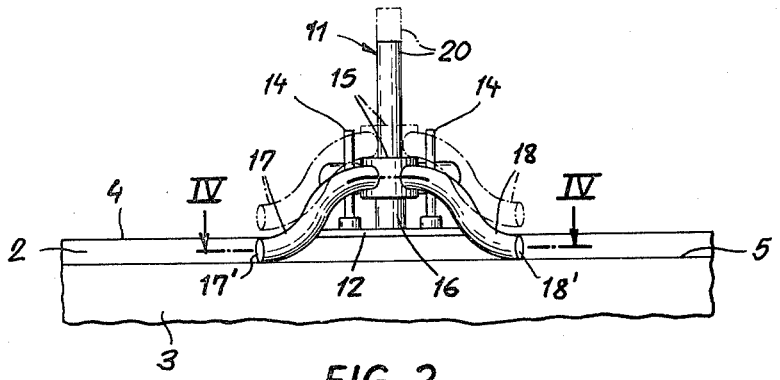
FIG. 2 is an elevational view of the automatic ball spinner taken along line II—II of FIG. 1.
Figure 3:
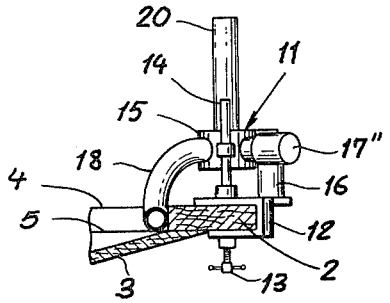
FIG. 3 is a side view of the automatic ball spinner, partially in section and taken along line III—III of FIG. 1.

FIGS. 1–3 show a roulette wheel 1 made of wood and having a circular rim 2 and a downwardly converging frustoconical bowl 3 within the rim 2 and joined thereto spaced slightly below the upper surface 4 of rim 2 to form a track 5 therewith for a roulette ball 6. The lower portion of bowl 3 has a circular opening 7 centered therein to accommodate a rotatable wheel head 8 having a series of numbered compartments 9 and a handle 10.

Figure 4:
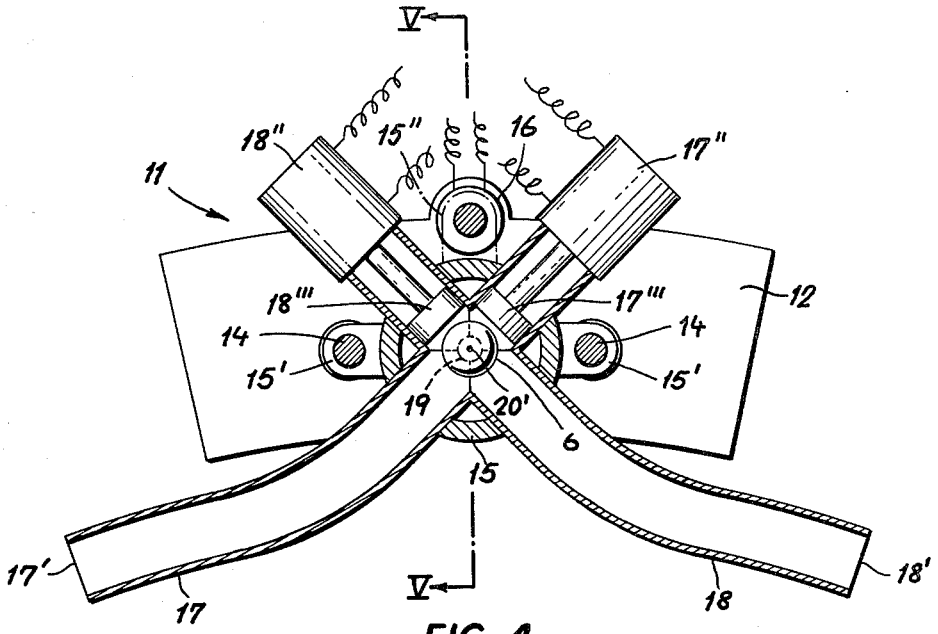
FIG. 4 is a sectional view of the automatic ball spinner taken along line IV—IV of FIG. 2.
Figure 5:
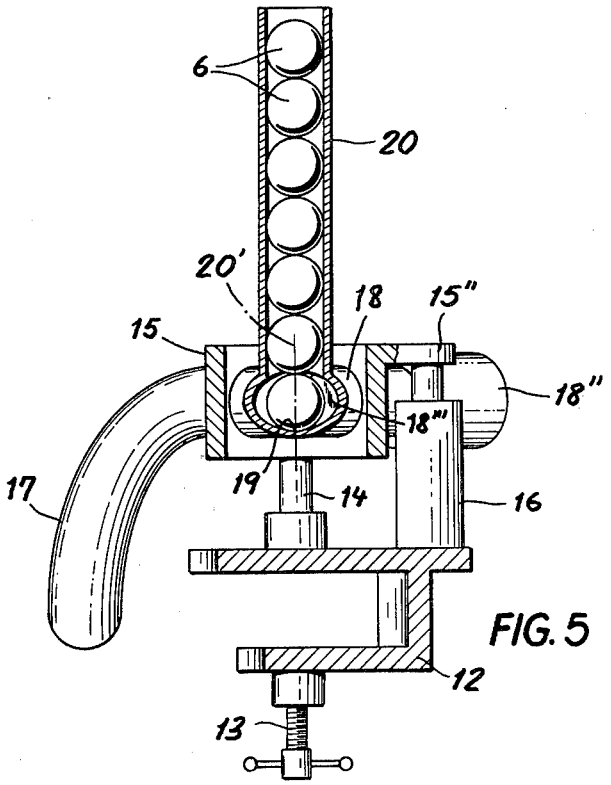
FIG. 5 is a sectional view taken along line V—V of FIG. 4.

An automatic roulette ball spinner 11 has a C-shaped base 12 which is fitted onto the rim 2 and held in place by a screw clamp 13, which allows the ball spinner to be relocated anywhere along rim 2. Mounted on base 12 are a pair of vertical rods 14 which form vertical guides for a vertically displaceable yoke 15 having projections 15' which engage the rods 14, and a further projection 15'' which is engaged by an electrically operated vertical jack 16 mounted on the base 12. A pair of guide tubes 17 and 18 are mounted in yoke 15 and intersect one another within the perimeter thereof, the tubes 17, 18 having a curvature adjacent the open ends 17' and 18' thereof conforming to the circular track 5 for guiding the balls 6 tangentially thereonto. The other ends of guide tubes 17, 18 are provided with respective electrically operated plungers 17'' and 18'', which, as can be seen in FIG. 4, are provided with respective pistons 17''' and 18''' confronting a ball 6 which is seated within the intersection of tubes 17, 18 in a shallow recess 19, formed in the dead bottom center of the intersecting tubes.

A magazine 20, for holding a number of balls 6, is formed by a vertical tube joining the intersection of guide tubes 17, 18 and has an axis 20' on which the recess 19 is centered.

A power supply 21 is connected to a programmer 22 by way of an on/off switch 23, the programmer 22 also being connected directly to the jack 16 and to the plungers 17'' and 18'' by way of a random power variator 24 and a random selector switch 25.

Figure 6:
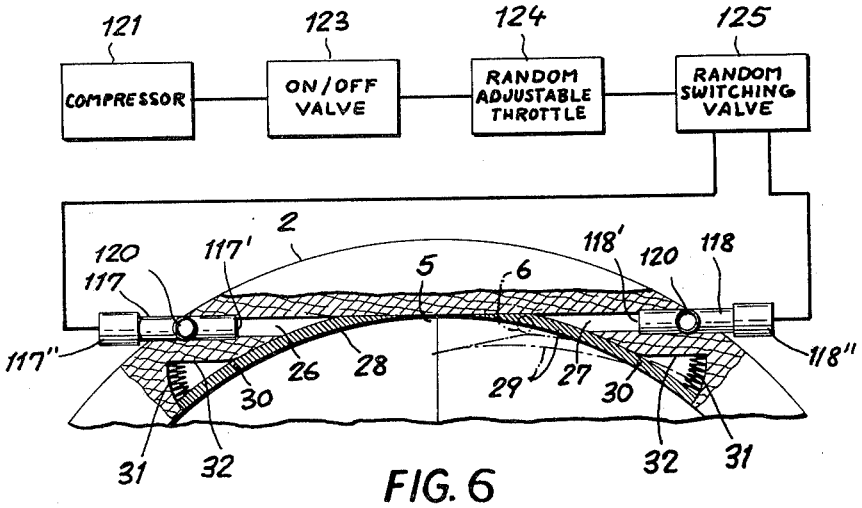
FIG. 6 is a top view with parts broken away of a roulette wheel having an automatic ball spinner according to another embodiment of the invention.

FIG. 6 shows another embodiment of the invention in which the guide tubes 117 and 118 are formed in the rim 2 and are provided with respective pneumatically operated plungers 117'' and 118'', which are connected to a compressor 121 by way of an on/off valve 123, a random adjustable throttle 124, and a random switching valve 125.

The open ends 117' and 118' of respective tubes 117 and 118 feed into respective bores 26 and 27 which are in axial alignment with these tubes and communicate tangentially with the track 5. The bores 26, 27 are blocked by respective arcuate flaps 28 and 29, swingable on pivots 30 and biased into a closed position by springs 31 seated in recesses 32 formed in rim 2. Each guide tube 117 and 118 is provided with a vertical ball magazine 120.

In the operation of the embodiment of the invention shown in FIGS. 1–5, the vertically displaceable guide tubes 17, 18 normally rest on the track 5. When play is ready to begin, the dealer closes the switch 23 and power is fed into programmer 22 from the power supply 21, which in turn feeds the power into the random power variator 24, which randomly varies the voltage available to the plungers 17'' and 18'', controlling the force with which the ball 6 is struck, and thereby its velocity as it enters the track 5. From the variator 24, the modified power is fed into the random selector switch 25 which randomly choses a plunger to activate. When activated, the chosen plunger drives its respective piston forward and strikes the ball 6 which is seated in the shallow recess 19 in order to keep it positioned within the intersection of tubes 17, 18, with the additional balls 6 in magazine 20 resting on this one ball, helping to keep it positioned. The ball 6 is propelled from the particular guide tube associated with the chosen plunger and the piston of that plunger recedes, being a standard spring-loaded solenoid, allowing another ball 6 to drop into place from magazine 20. As soon as the propelled ball leaves the guide tube, the programmer 22 automatically activates the jack 16, which vertically displaces the tubes 17, 18 from track 5 to allow the propelled ball to travel around the track without striking the tubes. The jack 16 remains activated and keeps the tubes 17, 18 elevated until the dealer shuts off the switch 23, after the ball enters a compartment 9 of the wheel head 8, which has been spun by the handle 10 in a direction opposite to the ball travel as soon as the ball emerged from a tube. With the jack 16 deactivated, the tubes 17, 18 settle down and come to rest on track 5 and the cycle is ready to begin again. The elevated position of the vertically displaceable elements of the ball spinner 11 can be seen in FIG. 2 in phantom lines.

In the operation of the embodiment of the invention shown in FIG. 6, the valve 123 is opened by the dealer at the beginning of play, allowing compressed air from compressor 121 to pass into the random adjustable throttle 124, which randomly modifies the pressure and therefore the striking force of the plunger, for the same reasons as previously described with relation to the power variator 24. The modified compressed air is then fed into the random switching valve 125 and into a randomly chosen plunger 117'' or 118''. A ball 6 fed from respective magazine 120 into the chosen tube 117 or 118 is propelled through bore 26 or 27 and deflects either flap 28 or 29, as shown in phantom lines, against the force of springs 31. As soon as the ball 6 leaves a bore 26, 27 and enters track 5, the respective flap 28 or 29 snaps shut and presents a clear path for the ball travel. Although not illustrated, the plungers 117'' and 118'' can be springloaded to bleed back the compressed air after the valve 123 is closed, presenting a venting position to the plungers.

It is also within the scope of the invention to form the guide tubes with internal rifling for imparting a spin to the roulette ball to achieve different effects in the ball travel.

I claim:

1. A gaming apparatus comprising:

a roulette wheel having a circular rim, a downwardly converging frustoconical bowl contained within said rim and joined thereto below the upper surface of said rim to form therewith a continuous circular track against said rim for a roulette ball, a rotatable wheel head centered within said bowl at the bottom thereof and formed with a plurality of numbered compartments for receiving said roulette ball; and an automatic roulette ball spinner having at least one guide tube positioned along said rim for directing said ball onto said track, said guide tube having a roulette ball magazine communicating therewith, and means for propelling said ball through said guide tube onto and around said track and a movable member connected with said guide tube and rectilinearly shiftable vertically for lowering said guide tube into a first position wherein the tube rests in the track for discharging said ball onto said track and raising said guide tube into a second position wherein the tube is raised above the track for allowing said ball to travel around said track uninterruptedly over at least one full turn thereof, said member having a vertical guide.

2. The apparatus defined in claim 1 wherein said means for propelling said ball is a powered plunger provided in said guide tube.

3. The apparatus defined in claim 2 further comprising a pair of said guide tubes directed oppositely to one another and positioned along said rim for directing said ball tangentially onto said track.

4. The apparatus defined in claim 3 further comprising selector means for randomly activating either of said powered plungers.

5. The apparatus defined in claim 4 further comprising means for randomly adjusting the propelling force of said powered plungers.

6. The apparatus defined in claim 5 further comprising electromagnetic means for actuating said plungers.

7. A gaming apparatus comprising:

a roulette wheel having a circular rim, a downwardly converging frustoconical bowl contained within said rim and joined thereto below the upper surface of said rim to form therewith a track for a roulette ball, a rotatable wheel head centered within said bowl at the bottom thereof and formed with a plurality of numbered compartments for receiving said roulette ball; and an automatic roulette ball spinner, said spinner having a pair of oppositely oriented guide tubes positioned along said rim for directing said ball tangentially onto said track, said guide tubes having a roulette ball magazine communicating therewith, a respective powered plunger provided in each of said guide tubes for propelling said ball through the respective tube, selector means for randomly activating either of said powered plungers, means for randomly adjusting the propelling force of said powered plungers, said pair of guide tubes being mounted on a common yoke, at least one vertical guide for said yoke, said guide tubes intersecting one another and said magazine feeding into the intersection thereof, and a powered jack for vertically displacing said yoke along said vertical guide, said automatic roulette ball spinner being displaceable along said rim and being further provided with locking means for maintaining a position on said rim.

* * * * *